US011833811B2

(12) United States Patent
Asai et al.

(10) Patent No.: US 11,833,811 B2
(45) Date of Patent: Dec. 5, 2023

(54) PRINTING APPARATUS

(71) Applicant: BROTHER KOGYO KABUSHIKI KAISHA, Nagoya (JP)

(72) Inventors: Sho Asai, Ama (JP); Yushi Kato, Nagoya (JP); Shotaro Watanabe, Nagoya (JP); Takehiko Inaba, Chita (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 199 days.

(21) Appl. No.: 17/556,926

(22) Filed: Dec. 20, 2021

(65) Prior Publication Data

US 2022/0203719 A1 Jun. 30, 2022

(30) Foreign Application Priority Data

Dec. 28, 2020 (JP) ..... 2020-219186

(51) Int. Cl.
*B41J 11/42* (2006.01)
*B41J 11/00* (2006.01)
*B41J 3/407* (2006.01)

(52) U.S. Cl.
CPC ..... *B41J 11/42* (2013.01); *B41J 3/4075* (2013.01); *B41J 11/0045* (2013.01)

(58) Field of Classification Search
CPC ..... B41J 11/42; B41J 11/0045; B41J 3/4075; B41J 29/00; B41J 29/02; B41J 29/023; B41J 29/026; B65C 11/0289; B65C 2210/0078; B65C 2210/0094; B65C 9/00; B65C 9/46
See application file for complete search history.

(56) References Cited

U.S. PATENT DOCUMENTS 7,982,758 B2 * 7/2011 Marcus ..... B41J 17/02 347/215
8,169,453 B2 * 5/2012 Mindler ..... B41J 2/325 347/216

FOREIGN PATENT DOCUMENTS

EP 3184314 A1 * 6/2017 ..... B41J 11/0045
JP 2007-8061 A 1/2007
JP 2016-137683 A 8/2016

* cited by examiner

*Primary Examiner* — Kristal Feggins
(74) *Attorney, Agent, or Firm* — KENEALY VAIDYA LLP

(57) ABSTRACT

A printing apparatus includes a platen roller conveying a printing medium in a first direction, a peeler peeling off a label from a mount, a support member supporting a driven roller that conveys the mount in a second direction with the platen roller, and a rib portion provided on the support member and guiding the label peeled off from the mount in the first direction. The rib portion includes a first rib, a second rib and a third rib, continuously in the first direction. The first rib is inclined away from a virtual line in the first direction toward an upstream side from the second rib. The third rib is inclined away from the virtual line in the first direction toward a downstream side from the second rib.

10 Claims, 5 Drawing Sheets

PRINTING APPARATUS

CROSS-REFERENCE TO RELATED APPLICATIONS

This application is based on and claims priority under 35 USC 119 from Japanese Patent Application No. 2020-219186 filed on Dec. 28, 2020, the contents of which are incorporated herein by reference.

TECHNICAL FIELD

The present disclosure relates to a printing apparatus, and particularly, to a printing apparatus configured to perform peeling processing on a printing medium.

BACKGROUND

A related art discloses a printing apparatus configured to perform printing processing on a printing medium where a plurality of labels having an adhesive layer is discretely put on a mount having a long shape.

Here, the label that configures the printing medium after the printing processing is peeled off from the mount by a peeler unit. At this time, since the label has the adhesive layer, it is preferable to suppress the label from being stuck to the peeler unit.

Therefore, the related art provides a peel base body of the peeler unit with a rib to prevent a situation where the label discharged from a label discharge port is closely contacted to the peel base body and is thus difficult to be taken out.

SUMMARY

One illustrative aspect of the present disclosure provides a printing apparatus configured to perform printing processing on a printing medium, the printing medium having a plurality of labels with an adhesive layer being discretely put on a mount having a long shape. The printing apparatus includes: a platen roller rotatably supported by a platen holder, the platen roller being configured to convey the printing medium in a first conveying direction; a peeler member disposed downstream of the platen roller in the first conveying direction, the peeler member being configured to peel off the label from the mount by bending the mount in a second conveying direction, the second conveying direction being different from the first conveying direction; a roller configured to convey the mount bent by the peeler member in the second conveying direction with nipping the mount between the roller and the platen roller; a support member disposed downstream of the peeler member in to the first conveying direction, the support member being configured to rotatably support the roller; and a rib portion provided on the support member so as to extend in the first conveying direction, the rib portion being configured to guide the label peeled off from the mount in the first conveying direction. The rib portion includes a first rib, a second rib and a third rib, continuously from an upstream side toward a downstream side in the first conveying direction. The first rib is inclined away from a first virtual straight line in the first conveying direction toward an upstream side from the second rib, the first virtual straight line connecting the peeler member and the second rib. The third rib is inclined away from the first virtual straight line in the first conveying direction toward a downstream side from the second rib.

In the present disclosure, the plurality of labels is discretely put on the mount having a long shape of the printing medium. The printing medium is conveyed by the platen roller and the mount is bent by the peeler member, so that the label is peeled off from the mount. The mount, from which the label has been peeled off, is nipped and conveyed by the platen roller and the roller.

The support member is provided with the rib portion configured to guide the label after peeled off from the mount. The rib portion continuously has the first rib, the second rib and the third rib in corresponding order from the upstream side toward downstream side in the conveying direction. When assuming the first virtual straight line connecting the peeler member and the second rib, the first rib is inclined in the direction away from the first virtual straight line, from the second rib toward the further upstream side in the conveying direction. The third rib is inclined in the direction away from the first virtual straight line, from the second rib toward the further downstream side in the conveying direction.

Due to the positional relationship among the first rib, the second rib and the third rib, the label after peeled off from the mount shows following conveying behaviors.

In a case of a label where the adhesive force of the adhesive layer to the mount is relatively strong, the label is conveyed downstream in the conveying direction while the downstream-side end portion of the adhesive layer of the label peeled off from the mount in the conveying direction is in contact with the first rib. When the downstream-side end portion of the adhesive layer of the label in the conveying direction reaches the second rib, the adhesive layer of the label becomes in a state of not being in contact with the first rib. Thereafter, the label is advanced downstream in the conveying direction with keeping a state where the adhesive layer is in contact with the second rib and the adhesive layer is not in contact with the third rib. However, in a case of a label where a bending habit (so-called curl) is particularly strong, the label may be conveyed in the conveying direction while the downstream-side end portion of the adhesive layer of the label peeled off from the mount in the conveying direction is exceptionally in contact with the third rib.

In a case of a label where the adhesive force of the adhesive layer to the mount is relatively weak, the downstream-side end portion of the adhesive layer of the label peeled off from the mount in the conveying direction reaches the second rib without being in contact with the first rib. Thereafter, the label is advanced downstream in the conveying direction with keeping the state where the adhesive layer is in contact with the second rib and the adhesive layer is not in contact with the third rib. However, in a case of a label having relatively high rigidity, the label may be conveyed while the downstream-side end portion of the adhesive layer of the label in the conveying direction is not in contact with the second rib. In the case where the bending habit is particularly strong, similar to the above, the label may be conveyed in the conveying direction while the downstream-side end portion of the adhesive layer of the label in the conveying direction is exceptionally in contact with the third rib.

According to the present disclosure, it is possible to suppress the peeling defect of the label and to smoothly convey the label, irrespective of strength and weakness of the adhesive force of the adhesive layer of the label.

BRIEF DESCRIPTION OF THE DRAWINGS

Illustrative embodiments of the disclosure will be described in detail based on the following figures, wherein.

DETAILED DESCRIPTION

In the above-described related art, in a case where an adhesive force of the adhesive layer of the label is strong, a conveying defect where the label is pasted to the peel base body without being smoothly peeled off from the mount may occur.

Therefore, illustrative aspects of the present disclosure provide a printing apparatus that suppresses a peeling defect of a label and smoothly conveys the label.

Hereinafter, a printing apparatus according to an illustrative embodiment of the present disclosure will be described with reference to the drawings. Note that, in descriptions below, as shown in FIG. 1, each direction of the front, rear, left, right, upper and lower is defined in a state where a printing apparatus 1 is placed on a desk.

Figure 1:
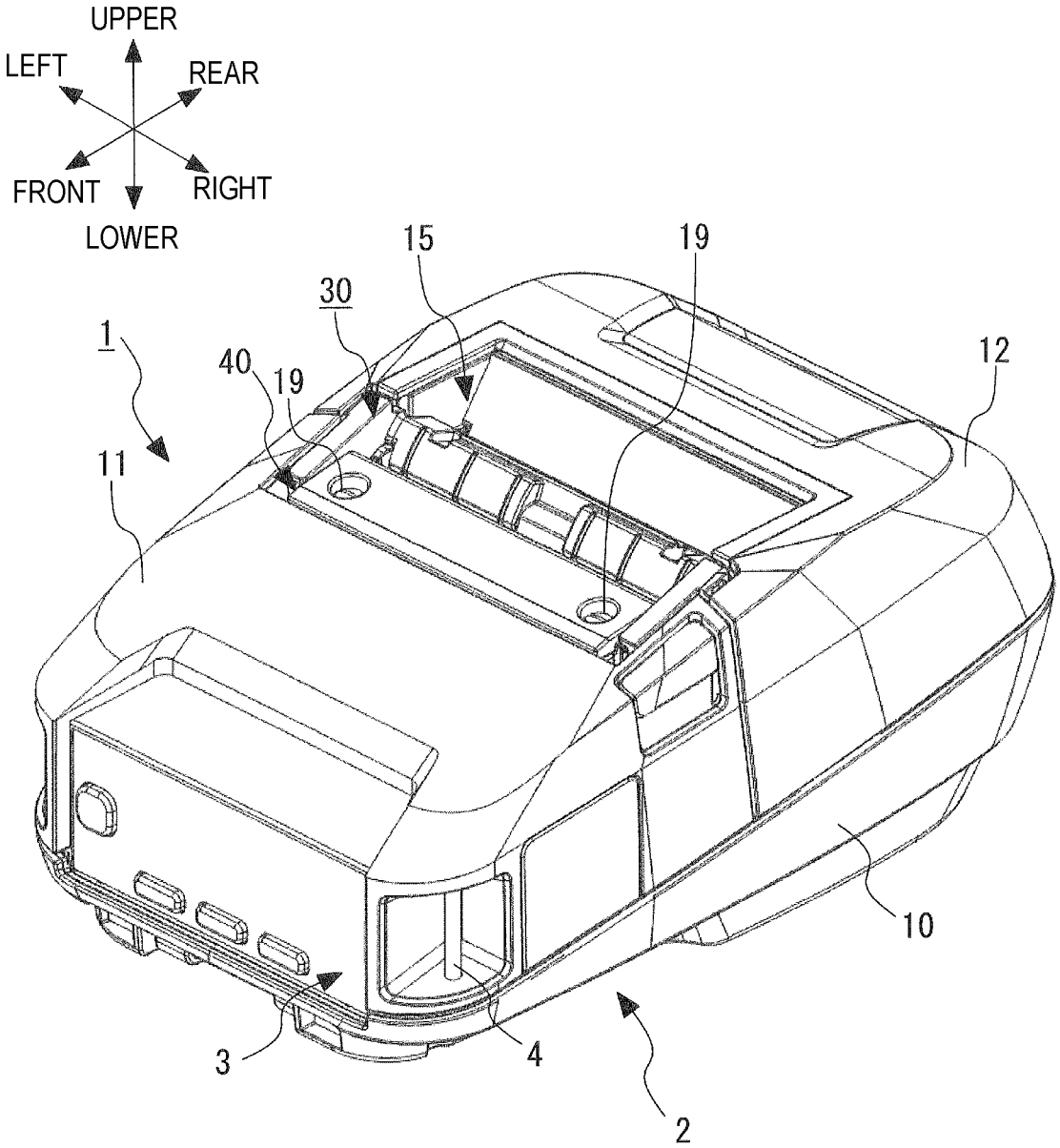
FIG. 1 is an appearance perspective view of a printing apparatus.

In FIG. 1, the printing apparatus 1 has a lower case 10 as the main body, an upper front-side cover 11, and an upper rear-side cover 12, which configure a substantially rectangular three-dimensional housing 2.

The lower case 10 is provided on a front surface with an operation panel unit 3 on which a variety of operation switches are disposed, and hook portions 4 to which both ends of a portable strap (not shown) are engaged are provided at left and right corner portions ranging from the front surface to side surfaces.

Note that, although not shown, the lower case 10 is provided with various connection units such as a USB port and an RS-232C connector, for example, as a communication means, and can connect to a supply of electric power, a print data input terminal (for example, a personal computer, a bar-code reader and the like), and the like. In addition to the communication means, a variety of functions of wired LAN, wireless LAN and Bluetooth (registered trademark) are mounted, and a label including variable data (text, bar-code) can be issued simply by transmitting text data to the printing apparatus 1 by using the various communication means.

In addition, the labels to be issued may include labels used in various fields such as an actual product label and a tag label for manufacturing/logistics, a food label and a price tag label for retail, a sample label and a medicine notebook label for medical use, and the like. In this case, as a printing medium that is used in the present illustrative embodiment, a printing medium where a plurality of labels having an adhesive layer is discretely put on a mount having a long shape is used.

Figure 2:
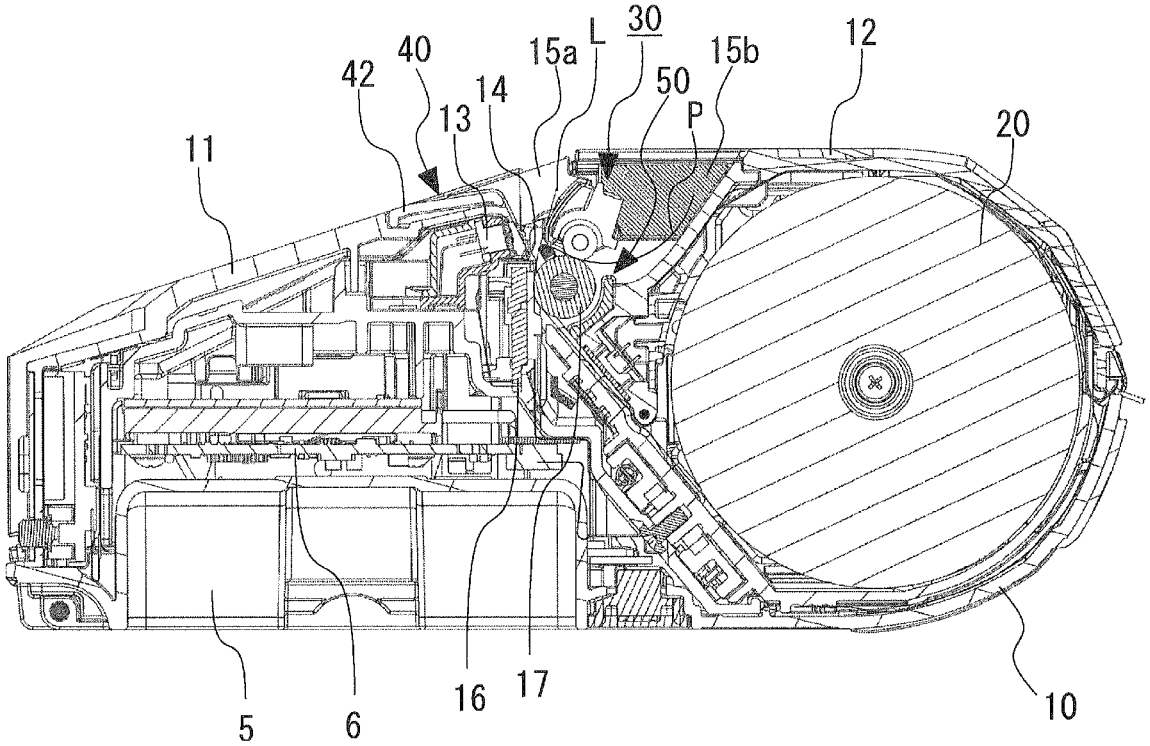
FIG. 2 is a longitudinally sectional view of a central part of the printing apparatus.

As shown in FIG. 2, the printing apparatus 1 is provided therein with electronic components relating to drive and control such as a charging-type battery 5 and a circuit board 6, a detection unit 13 including an optical sensor configured to presence or absence of a label and a mountain-like front-side tear bar 14 continuing in the right and left direction, which are located below the upper front-side cover 11, and a discharge port 15 (refer to FIG. 1), a print head 16 configured to execute predetermined printing processing and a platen roller 17 disposed between a rear end portion of the upper front-side cover 11 and a tip end portion of the upper rear-side cover 12. Note that, the print head 16 is disposed to face the platen roller 17.

The upper front-side cover 11 is provided with an upper unit 40 of a peeler unit 30 so as to be detachably installed by a pair of left and right screws 19.

Below the upper rear-side cover 12, a roll 20 on which the printing medium is wound is replaceably accommodated. The printing medium has a plurality of labels L having an adhesive layer and discretely put on a mount P having a long shape. For example, the labels L are removably stuck on the mount P. The upper rear-side cover 12 is configured to be swingable between a closed position in which an upper including the roll 20 is covered and an opened position in which the cover is opened so that the roll 20 can be acquired, and is configured to function as an opening/closing cover supported near a rear end of the lower case 10, which is a rotation fulcrum.

In addition, the rear end portion of the upper front-side cover 11 and the tip end portion of the upper rear-side cover 12 are spaced, and the spaced portion is provided with the discharge port 15 through which the printing medium after printing is discharged according to the type of the label to be issued.

Note that, the upper rear-side cover 12 is provided with a lower unit 50 of the peeler unit 30 so as to be detachably installed by screws (not shown).

Figure 3:
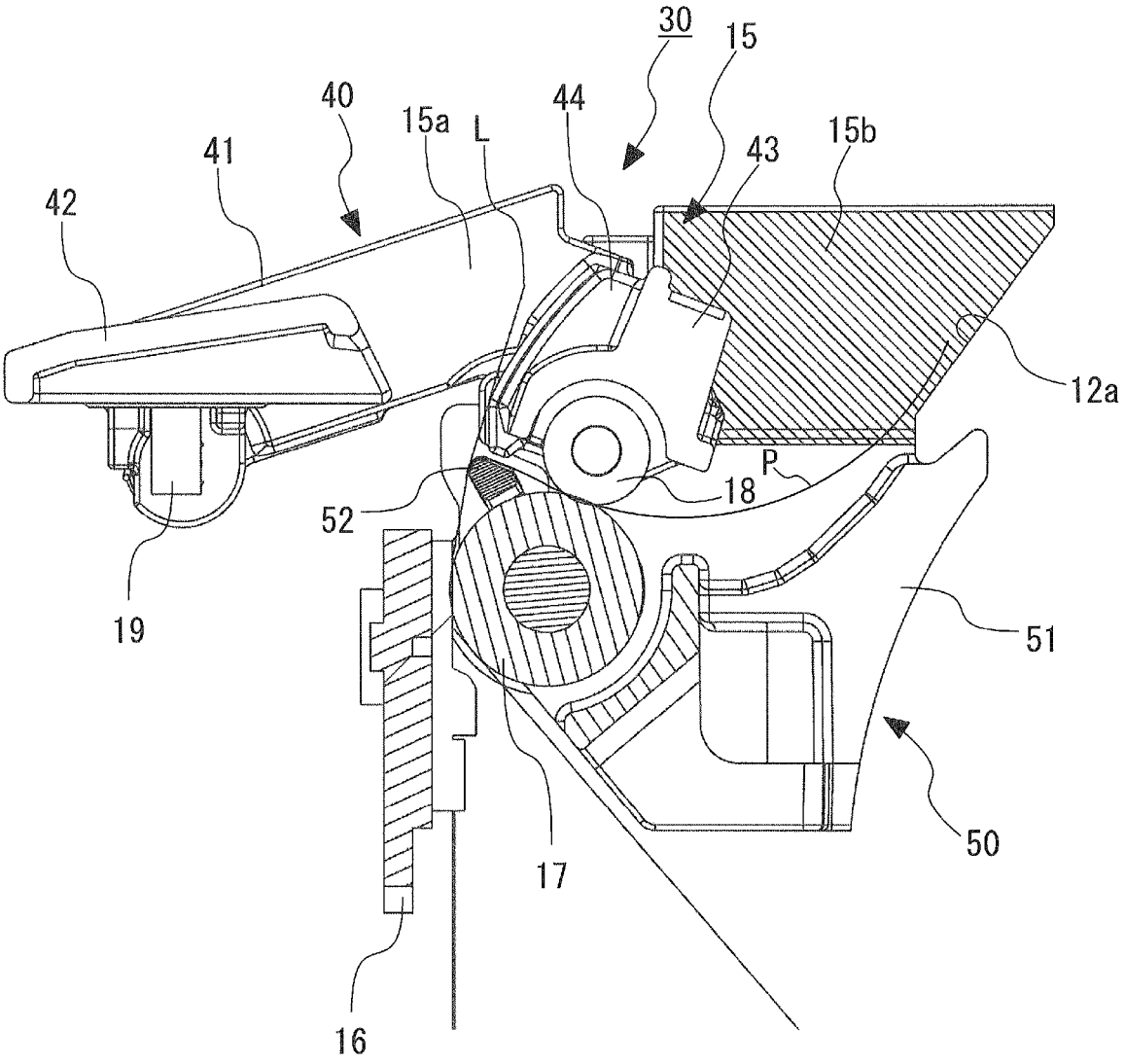
FIG. 3 is an enlarged longitudinally sectional view of main parts of the printing apparatus.

Note that, as shown in FIG. 3, the discharge port 15 is configured by a discharge port 15*a* for the label L peeled off from the mount P on the front-side and a discharge port 15*b* for the mount P on the rear-side. Here, the upper rear-side cover 12 is provided with an inclined surface 12*a* inclined in such a form that a front side is low and a rear side is high so as to also serve as a bottom surface of the mount discharge port 15*b* for convenient attachment when attaching the lower unit 50 and for guiding of the mount P when discharging the mount P.

As described above, the peeler unit 30 configured to peel off the label L from the mount P includes the upper unit 40 attached to the upper front-side cover 11 via the screws 19 and the lower unit 50 attached to the upper rear-side cover 12 via the screws (not shown).

Figure 4:
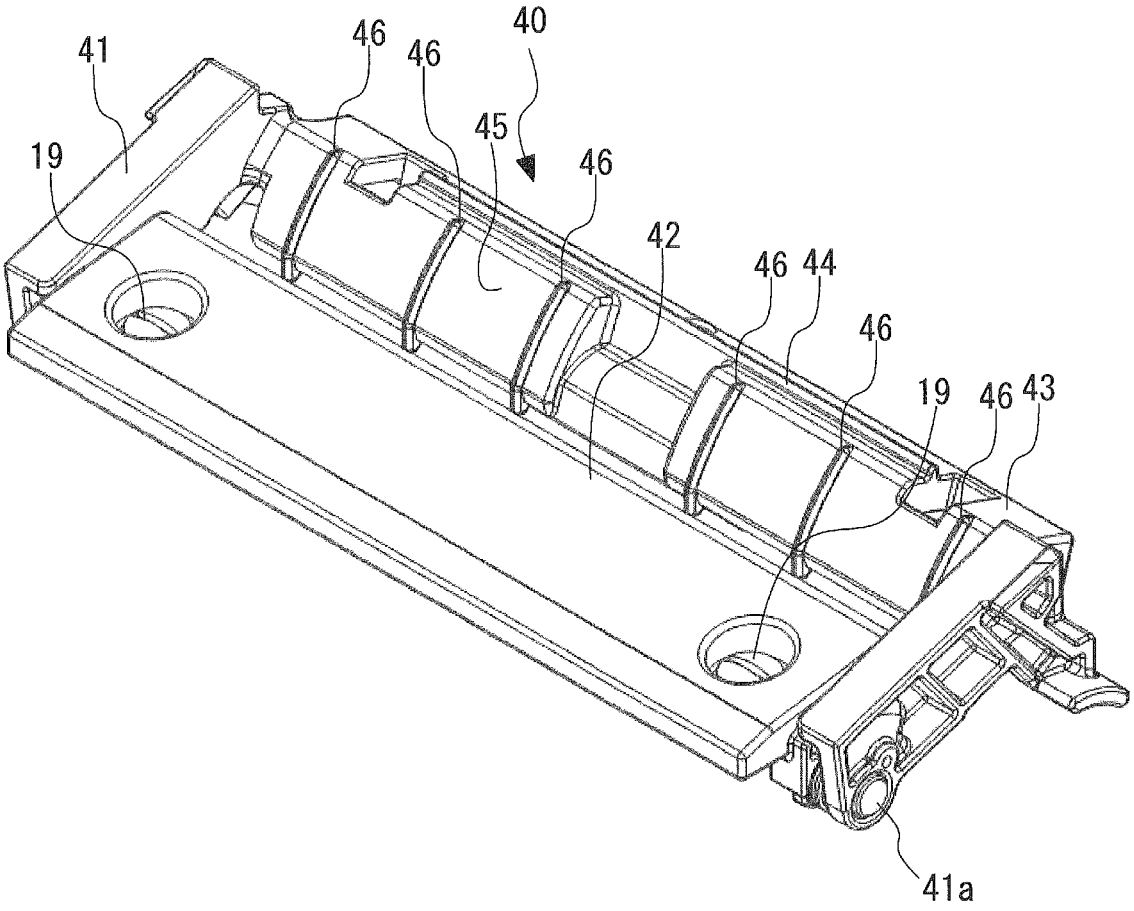
FIG. 4 is a perspective view of an upper unit of a peeler unit.

As shown in FIG. 4, the upper unit 40 includes a pair of left and right bracket parts 41, a stand part 42 disposed between tip end portions of the bracket parts 41, a driven roller 18 bridged between rear end portions of the bracket parts 41, a roller holder part 43 as a support member configured to pivotally support both ends of the driven roller 18, and a guide part 44 formed on a front surface-side of the roller holder part 43.

The bracket parts 41 are swingably supported to the stand part 42 by shaft parts 41*a*.

The driven roller 18 is configured to come into contact with the platen roller 17 near an upper rear portion of the platen roller 17, thereby rotating in a driven manner to nip and convey the mount P.

The roller holder part 43 is configured to rotatably support the driven roller 18 so as to cover the upper of the driven roller 18, and to divide the discharge port 15 into the discharge port 15*a* for the label L and the discharge port 15*b* for the mount P.

The guide part 44 integrally has a guide surface part 45 as an installation surface bent and curved so that a midway portion near the lower in the upper and lower direction is located in the foremost position and becomes a ridge line extending in the right and left direction, and a plurality of rib portions 46 protruding forward from the guide surface part 45 and provided spaced by predetermined intervals at a plurality of portions in the right and left direction.

The lower unit 50 has a pair of left and right bracket parts 51, a peeler part 52 as a peeler member configured to bend and separate the mount P from the label L, and the platen roller 17 disposed below the peeler part 52 and pivotally supported by the bracket parts 51 as the platen holder.

The peeler part 52 has an R-shaped section on a tip end-side, and is configured to bend the mount P. The bent mount P is nipped and conveyed by the platen roller 17 and the driven roller 18. Since the label L stuck on the mount P is not bent due to its rigidity even when the mount P is bent, the label L is peeled off from the mount P. In this way, the peeler part 52 is configured to gradually peel off the label L after printing from the mount P by conveying the bent mount P.

As described above, the printing apparatus 1 is configured to perform printing on the printing medium (roll 20). The printing medium has the plurality of labels L with an adhesive layer being discretely stuck on the mount P having a long shape. The printing apparatus 1 includes the platen roller 17, the peeler part 52, the driven roller 18, the roller holder part 43 and the rib portions 46. The platen roller 17 rotatably supported by the bracket parts 51 and configured to convey the printing medium upward in the upper and lower direction. The peeler part 52 is disposed downstream of the platen roller 17 with respect to the upper and lower direction and is configured to peel off the label L from the mount P by bending the mount P rearward in the front and rear direction. The driven roller 18 is configured to convey the mount P bent by the peeler part 52 rearward in the front and rear direction with nipping the mount P between the driven roller 18 and the platen roller 17. The roller holder part 43 is disposed downstream of the peeler part 52 with respect to the upper and lower direction and is configured to rotatably support the driven roller 18. The rib portions 46 are provided on the front surface-side of the roller holder part 43 and extend along the upper and lower direction so as to guide upward the label L peeled off from the mount P in the upper and lower direction.

The roller holder part 43 integrally has the guide surface part 45 as an installation surface extending substantially in parallel to the length direction of the platen roller 17. The plurality of rib portions 46 (e.g., a total of six, in FIG. 4) is provided at predetermined intervals on the guide surface part 45.

As such, the roller holder part 43 extending along a direction of a shaft center R of the platen roller 17 is provided with the plurality of rib portions 46 at the predetermined intervals along the direction of the shaft center R, so that the guide function by the rib portions 46 can be exhibited evenly in the width direction of the printing medium.

At this time, the label L can be subjected to simultaneous printing at two places (two labels) on the left and right sides, for example.

Figure 5A:
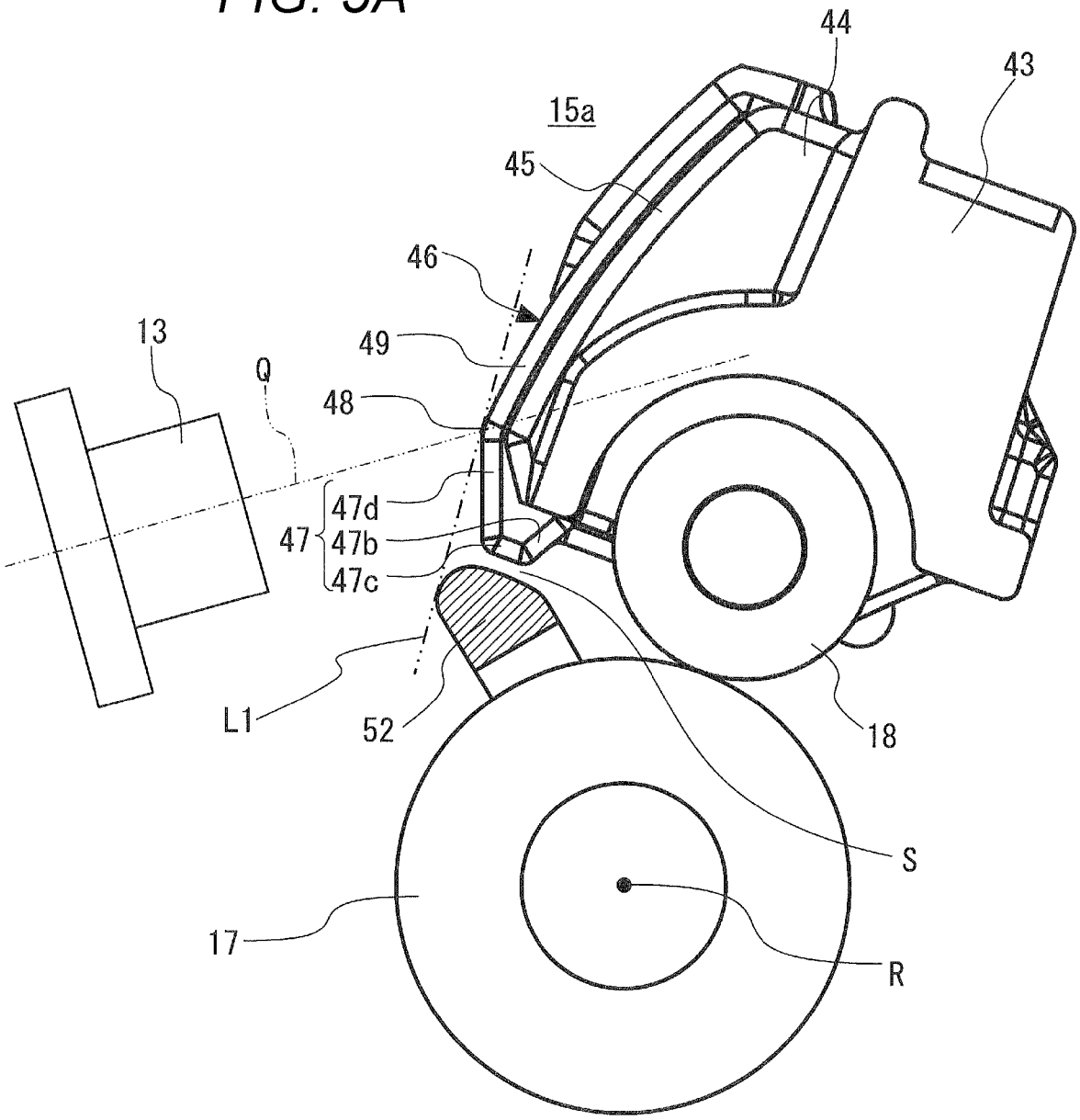
FIGS. 5A to 5C illustrate a relationship between a rib shape of the peeler unit and a sensor.
Figure 5B:
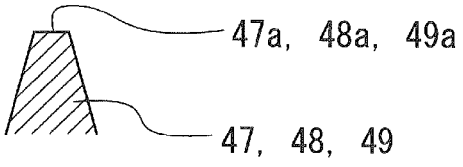
Figure 5C:
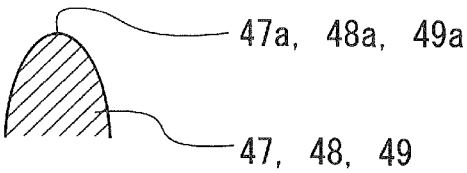

As shown in FIGS. 5A to 5C, the rib portion 46 has a first rib 47 having a first surface 47*a*, a second rib 48 having a second surface 48*a* and a third rib 49 having a third surface 49*a*, continuously from an upstream side with respect to the upper and lower direction toward a downstream side with respect to the upper and lower direction.

In addition, the first rib 47 has a rear rib 47*b* on a downstream side with respect to the discharge direction of the mount P, a middle rib 47*c* on a further upstream side than the rear rib 47*b* with respect to the discharge direction of the mount P and a front rib 47*d* on an upstream side with respect to the discharge direction of the label L, which are continuously formed bent so as to be folded back.

The middle rib 47*c* faces the peeler part 52 with a predetermined gap S. Here, the gap S has such a dimension (height) that the mount P bent by the peeler part 52 can pass through.

Thereby, the predetermined gap S can be interposed between the upstream-side end portion of the first rib 47 with respect to the conveying direction and the peeler part 52, so that the mount P bent by the peeler part 52 can be enabled to smoothly pass through. Note that, the gap S can be further widened by causing the upper unit 40 to swing. Therefore, for example, it is also possible to easily nip the mount P before start of the printing processing between the platen roller 17 and the driven roller 18 via the peeler part 52 in advance by a user's manual operation.

When assuming a first virtual straight line L1 (refer to the end face shape in FIG. 5A to 5C) connecting an outer peripheral surface of the peeler part 52 and the second surface 48*a* of the second rib 48, the first surface 47*a* of the first rib 47 is inclined in a direction away from the first virtual straight line L1 connecting the outer peripheral surface of the peeler part 52 and the second surface 48*a* of the second rib 4, from the upstream-side end portion of the second surface 48*a* of the second rib 48 with respect to the upper and lower direction toward the further upstream side with respect to the upper and lower direction. The third surface 49*a* of the third rib 49 is inclined in a direction away from the first virtual straight line L1, from the downstream-side end portion of the second surface 48*a* of the second rib 48 with respect to the upper and lower direction toward the further downstream side with respect to the upper and lower direction.

Note that, as used herein, the term 'surface' may include a case where a protruding end face of each of the ribs 47, 48 and 49 where a sectional shape is a trapezoidal shape is formed as each of the first surface 47*a*, the second surface 48*a* and the third surface 49*a*, for example, as shown in FIG. 5B. The term 'surface' may also include a case where a ridge line of each of the ribs 47, 48 and 49 where a sectional shape is a semi-elliptical shape is formed as each of the first surface 47*a*, the second surface 48*a* and the third surface 49*a*, for example, as shown in FIG. 5C.

As described above, in the printing medium, the plurality of labels L is discretely stuck on the mount P having a long shape. The printing medium is conveyed by the platen roller 17 and the mount P is bent by the outer peripheral surface of the peeler part 52, so that the label L is peeled off from the mount P.

The mount P from which the label L has been peeled off is nipped and conveyed by the platen roller 17 and the driven roller 18. The driven roller 18 is disposed along the shaft center of the platen roller 17. The driven roller 18 is rotatably supported by the roller holder part 43 extending along the shaft center.

The guide surface part 45 of the roller holder part 43 is provided with the rib portions 46 configured to guide the label L after peeled off from the mount P. The rib portion continuously has the first rib 47, the second rib 48 and the third rib 49 in corresponding order from the upstream side toward downstream side with respect to the conveying direction.

Due to the positional relationship among the first rib 47, the second rib 48 and the third rib 49 as described above, the label L after peeled off from the mount P shows following conveying behaviors.

In a case of the label L where the adhesive force of the adhesive layer to the mount P is relatively strong, the label is conveyed downstream with respect to the conveying direction while the downstream-side end portion of the adhesive layer of the label L peeled off from the mount P with respect to the conveying direction is in contact with the first surface 47*a* of the first rib 47. When the downstream-side end portion of the adhesive layer of the label L with respect to the conveying direction reaches the second surface 48*a* of the second rib 48, the adhesive layer of the label L becomes in a state of not being in contact with the first surface 47*a* of the first rib 47.

Thereafter, the label L is advanced downstream with respect to the conveying direction with keeping a state where the adhesive layer is in contact with the second surface 48*a* of the second rib 48 and the adhesive layer is not in contact with the third surface 49*a* of the third rib 49. However, in a case of the label L where a bending habit (so-called curl) is particularly strong, the label L may be conveyed in the conveying direction while the downstream-side end portion of the adhesive layer of the label L peeled off from the mount P with respect to the conveying direction is exceptionally in contact with the third surface 49*a* of the third rib 49.

In a case of the label L where the adhesive force of the adhesive layer to the mount P is relatively weak, the downstream-side end portion of the adhesive layer of the label L peeled off from the mount P with respect to the conveying direction reaches the second surface 48*a* of the second rib 48 without being in contact with the first surface 47*a* of the first rib 47. Thereafter, the label is advanced downstream with respect to the conveying direction with keeping the state where the adhesive layer is in contact with the second surface 48*a* of the second rib 48 and the adhesive layer is not in contact with the third surface 49*a* of the third rib 49.

However, in a case of the label L having relatively high rigidity, the label may be conveyed while the downstream-side end portion of the adhesive layer of the label L with respect to the conveying direction is not in contact with the second surface 48*a* of the second rib 48. In the case where the bending habit is particularly strong, similar to the above, the label may be conveyed in the conveying direction while the downstream-side end portion of the adhesive layer of the label L with respect to the conveying direction is exceptionally in contact with the third surface 49*a* of the third rib 49.

In this way, in principle, the adhesive layer of the label L is conveyed in the state of not being in contact with the third surface 49*a* of the third rib 49, irrespective of strength and weakness of the adhesive force of the adhesive layer. Thereby, since it is possible to reduce the conveying load at the time of conveying the label L, it is possible to smoothly convey the label L.

Note that, the peeler unit 30 uses the printing medium (roll 20) where the plurality of labels L is discretely stuck on the mount P having a long shape, and can peel off the label L from the mount P and discharge the mount P and the label L in a separated state through the discharge port 15.

The detection unit 13 is provided to a front-side installation part. The detection unit 13 is configured to detect presence or absence of the label L, which is discharged from the discharge port 15 while being peeled off from the mount P via the peeler unit 30, in a contactless manner. The peeler unit 30 is installed to a rear-side installation part.

Specifically, the detection unit 13 disposed to face the guide surface part 46 is configured to emit sensor light and to receive the sensor light reflected on the label L in a state of being at least partially peeled off from the mount P and guided by the rib portions 46, thereby detecting the label L.

At this time, the detection unit 13 is disposed in any one position of a first portion (refer to FIG. 5A) at which an optical axis Q of the sensor light intersects with a second virtual straight line connecting the plurality of rib portions 46 (along the direction of the shaft center R of the platen roller 17) or a second portion at which one rib portion 46 is located on the optical axis Q of the sensor light. In particular, the detection unit 13 is preferably disposed in a position in which the second virtual straight line connecting the second surfaces 48*a* of the second ribs 48 along the direction of the shaft center R of the platen roller 17 intersects with the optical axis Q of the sensor light or a position in which the second surface 48*a* of one second rib 48 is located on the optical axis Q of the sensor light.

As described above, the mount P is bent at the peeler part 52, so that the label L is peeled off, and the peeled label L is guided by the rib portions 46.

In principle, the label L is kept in the state where the adhesive layer is in contact with the second surface 48*a* of the second rib 48 and the adhesive layer is not in contact with the third surface 49*a* of the third rib 49.

Then, the detection unit 13 is configured to emit the sensor light for detection toward the label L in such a stable posture.

Considering such environment, the detection unit 13 is disposed at the first portion or the second portion. In a case where the detection unit is disposed at the first portion, the optical axis Q of the emitted sensor light intersects with the second virtual straight line connecting the plurality of rib portions 46 (for example, a line connecting the second ribs 48 along the direction of the shaft center R of the platen roller 17). In addition, in a case where the detection unit is disposed at the second portion, one rib portion 46 is located on the optical axis Q of the sensor light. In any case, since a distance from the detection unit 13 to the rib portion 46 can be defined as short as possible and stably, the detection accuracy for the label L peeled off from the mount P and guided to the rib portions 46 can be improved.

Then, after preparing the label L by using desired print data, the user can paste the label L discharged from the discharge port 15*a* to a desired sticking object.

In the above, the illustrative embodiment of the present disclosure has been described in detail with reference to the accompanying drawings. However, the scope of the technical scope of the present disclosure is not limited to the above illustrative embodiment. It is obvious to one skilled in the art that a variety of changes, modifications, combinations and the like can be made within the scope of the technical scope of the present disclosure. Therefore, the technology of the changes, modifications, combinations and the like is also included within the scope of the present disclosure.

Also, other than mentioned above, the above illustrative embodiment and methods of each of the modified illustrative embodiments may be combined for use as appropriate.

Although not specifically exemplified, the present invention is put into practice with various changes made within a range not departing from the scope of the present invention.

What is claimed is:

1. A printing apparatus configured to perform printing processing on a printing medium, the printing medium having a plurality of labels with an adhesive layer being discretely put on a mount having a long shape, the printing apparatus comprising:

a platen roller rotatably supported by a platen holder, the platen roller being configured to convey the printing medium in a first conveying direction;

a peeler member disposed downstream of the platen roller in the first conveying direction, the peeler member being configured to peel off the label from the mount by bending the mount in a second conveying direction, the second conveying direction being different from the first conveying direction;

a roller configured to convey the mount bent by the peeler member in the second conveying direction with nipping the mount between the roller and the platen roller;

a support member disposed downstream of the peeler member in the first conveying direction, the support member being configured to rotatably support the roller; and a rib portion provided on the support member so as to extend in the first conveying direction, the rib portion being configured to guide the label peeled off from the mount in the first conveying direction, the rib portion comprising a first rib, a second rib and a third rib, continuously from an upstream side toward a downstream side in the first conveying direction, wherein the first rib is inclined away from a first virtual straight line in the first conveying direction toward an upstream side from the second rib, the first virtual straight line connecting the peeler member and the second rib, and wherein the third rib is inclined away from the first virtual straight line in the first conveying direction toward a downstream side from the second rib.

2. The printing apparatus according to claim 1, wherein the first rib having an upstream-side end portion in the first conveying direction faces the peeler member with a predetermined gap therebetween, and wherein the gap has a dimension allowing the mount bent by the peeler member to pass through.

3. The printing apparatus according to claim 1, wherein the support member has an installation surface extending substantially in parallel to a length direction of the platen roller, and wherein the rib portions are provided in plural at predetermined intervals on the installation surface.

4. The printing apparatus according to claim 3, further comprising:

an optical sensor disposed to face the support member, the optical sensor being configured to emit sensor light and to detect the label in a state of being at least partially peeled off from the mount and being guided by the rib portions, wherein the optical sensor is disposed at a first position or a second position, an optical axis of the sensor light intersecting with a second virtual straight line in a case the optical sensor is disposed at the first position, one rib portion being located on the optical axis of the sensor light in a case the optical sensor is disposed at the second position, the second virtual straight line connecting the plurality of rib portions.

5. The printing apparatus according to claim 1, wherein the support member has an installation surface extending substantially in parallel to a length direction of the platen roller, wherein the rib portion is provided in plural at predetermined intervals on the installation surface along a direction parallel to the length direction of the platen roller, and wherein the printing apparatus further comprises an optical sensor disposed to face the support member, the optical sensor being configured to emit sensor light and to detect the label in a state of being at least partially peeled off from the mount and being guided by the second ribs.

6. The printing apparatus according to claim 5, wherein the optical sensor is disposed at a first position, an optical axis of the sensor light intersecting with a second virtual straight line in a case the optical sensor is disposed at the first position, the second virtual straight line connecting the second ribs along the direction parallel to the length direction the platen roller.

7. The printing apparatus according to claim 5, wherein the optical sensor is disposed at a second position facing at least one of the second ribs.

8. The printing apparatus according to claim 1, wherein the second rib is smaller in size than the first rib.

9. The printing apparatus according to claim 1, wherein the second rib is smaller in size than the third rib.

10. The printing apparatus according to claim 1, wherein the roller is a driven roller.

* * * * *